US008952319B2

(12) United States Patent
Rose

(10) Patent No.: US 8,952,319 B2
(45) Date of Patent: Feb. 10, 2015

(54) DOWNHOLE DEPLOYABLE TOOLS FOR MEASURING TRACER CONCENTRATIONS

(75) Inventor: Peter E. Rose, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 224 days.

(21) Appl. No.: 13/041,013

(22) Filed: Mar. 4, 2011

(65) Prior Publication Data

US 2011/0215234 A1 Sep. 8, 2011

Related U.S. Application Data

(60) Provisional application No. 61/310,665, filed on Mar. 4, 2010.

(51) Int. Cl.
*G01V 5/04* (2006.01)
*E21B 47/10* (2012.01)

(52) U.S. Cl.
CPC ..... *E21B 47/1015* (2013.01)
USPC ..... 250/264

(58) Field of Classification Search
USPC ..... 250/264
See application file for complete search history.

(56) References Cited

U.S. PATENT DOCUMENTS

| | | | | |
|---|---|---|---|---|
| 3,233,674 A | | 2/1966 | Leutwyler | |
| 4,191,884 A | * | 3/1980 | Scott | 250/269.8 |
| 4,622,463 A | | 11/1986 | Hill | |
| 4,731,531 A | | 3/1988 | Handke | |
| 4,860,581 A | | 8/1989 | Zimmerman et al. | |
| 5,329,811 A | | 7/1994 | Schultz et al. | |
| 5,413,179 A | | 5/1995 | Scott | |
| 5,441,110 A | | 8/1995 | Scott | |
| 5,912,459 A | * | 6/1999 | Mullins et al. | 250/256 |
| 6,075,611 A | * | 6/2000 | Dussan et al. | 356/432 |
| 6,164,127 A | | 12/2000 | Izbicki et al. | |
| 6,223,822 B1 | | 5/2001 | Jones | |
| 6,437,326 B1 | * | 8/2002 | Yamate et al. | 250/269.1 |
| 6,564,866 B2 | | 5/2003 | Clark et al. | |
| 6,670,605 B1 | | 12/2003 | Storm et al. | |
| 7,025,138 B2 | | 4/2006 | Kurkjian et al. | |
| 7,038,201 B2 | | 5/2006 | Nichols | |

(Continued)

FOREIGN PATENT DOCUMENTS

WO WO 2007/019585 2/2007

OTHER PUBLICATIONS

P.-A Schnegg & F. Bossy, Sonde for Downhole Measurement of Water Turbidity and Dye Tracer Concentration, 2001 Swets & Zeitlinger Lisse, ISBN 902651, 795-798.

(Continued)

*Primary Examiner* — David Porta
*Assistant Examiner* — Kenneth J Malkowski
(74) *Attorney, Agent, or Firm* — Thorpe North & Western LLP

(57) ABSTRACT

Downhole deployable tools for measuring tracer concentrations are disclosed. According to one embodiment, an apparatus comprises a support cable configured to allow the apparatus to be lowered into and raised from a wellbore. A housing is attached to the support cable. The housing includes a detector window on the exterior of the housing. A detector system within the housing includes a detector that measures tracer concentrations. The detector is operably connected to the detector window to direct energy or particles from the detector window to the detector.

25 Claims, 4 Drawing Sheets

(56) References Cited

U.S. PATENT DOCUMENTS

| | | | | |
|---|---|---|---|---|
| 7,278,325 | B2 | 10/2007 | Fraser et al. | |
| 7,279,678 | B2 * | 10/2007 | Andrews et al. | 250/269.1 |
| 7,347,260 | B2 | 3/2008 | Ferguson et al. | |
| 7,432,499 | B2 | 10/2008 | Edwards et al. | |
| 7,638,761 | B2 | 12/2009 | Csutak | |
| 8,172,007 | B2 * | 5/2012 | Dolman et al. | 175/57 |
| 2006/0152383 | A1 | 7/2006 | Yamate et al. | |
| 2007/0120051 | A1 * | 5/2007 | DiFoggio et al. | 250/269.1 |
| 2007/0138399 | A1 * | 6/2007 | Simonetti et al. | 250/370.11 |
| 2009/0139713 | A1 | 6/2009 | Edwards et al. | |
| 2009/0284259 | A1 | 11/2009 | Csutak | |
| 2009/0288820 | A1 | 11/2009 | Barron et al. | |
| 2010/0314105 | A1 | 12/2010 | Rose | |
| 2011/0040484 | A1 | 2/2011 | Sabag et al. | |

OTHER PUBLICATIONS

Hirtz, Kunzman, Broaddus, Barbitta, Developments in tracer flow testing for geothermal production engineering, Geothermics 30 (2001) 727-745.

Brian G. Lovelock, Steam flow measurement using alcohol tracers, Geothermics 30 (2001) 641-654.

* cited by examiner

DOWNHOLE DEPLOYABLE TOOLS FOR MEASURING TRACER CONCENTRATIONS

RELATED APPLICATION

The present application claims the benefit of and priority to U.S. Provisional patent application Ser. No. 61/310,665, entitled "DOWNHOLE DEPLOYABLE TOOLS FOR MEASURING TRACER CONCENTRATIONS" filed on Mar. 4, 2010 and is hereby incorporated by reference.

BACKGROUND

Conventional approaches to measuring flow downhole in geothermal or engineered geothermal system (EGS) wellbores can be through the use of mechanical spinner tools, which makes use of a rotating paddle suspended and lowered (or raised) through the wellbore on a cable. But, such tools are notorious for failing, especially at high flow rates and at high temperatures, often due to mechanical failure and/or damage that occurs when lowering the mechanical spinner tool into a well. Likewise, non-uniformities in wellbore diameter can make calculating actual flow rate based on spinner rate data difficult and greatly complicate spinner-tool data interpretation. Further, spinner tools can be incapable of quantifying two-phase fluid flow (gas and liquid flow) within geothermal wellbores.

Radioactive tracers have been used to measure the success of hydraulic stimulations and characterize fracture properties such as surface area and volumes in petroleum wells. In a typical tracer test, the tracers, such as radioactively tagged proppant sands, can be introduced to a newly created fracture near the end of each phase of the stimulation process. Subsequent gamma logging can determine the location and relative importance of fractures created at each phase. Since such approaches involve the use of radioactive tracers, they can be expensive and potentially hazardous, especially to the environment. Likewise, such approaches use proppants, which are not commonly used in the hydraulic stimulation of geothermal or EGS reservoirs.

SUMMARY

Downhole deployable tools for measuring tracer concentrations are disclosed. According to one embodiment, an apparatus comprises a support cable configured to allow the apparatus to be lowered into and raised from a wellbore. A housing is attached to the support cable. The housing includes a detector window on the exterior of the housing. A detector system within the housing includes a detector that measures tracer concentrations. The detector is operably connected to the detector window to direct energy or particles from the detector window to the detector.

There has thus been outlined, rather broadly, features of the present embodiments so that the detailed description thereof that follows may be better understood, and so that the present contribution to the art may be better appreciated. Other features of the present embodiments will become clearer from the following detailed description, taken with the accompanying drawings and claims, or may be learned by the practice of the present embodiments.

Figure 1:
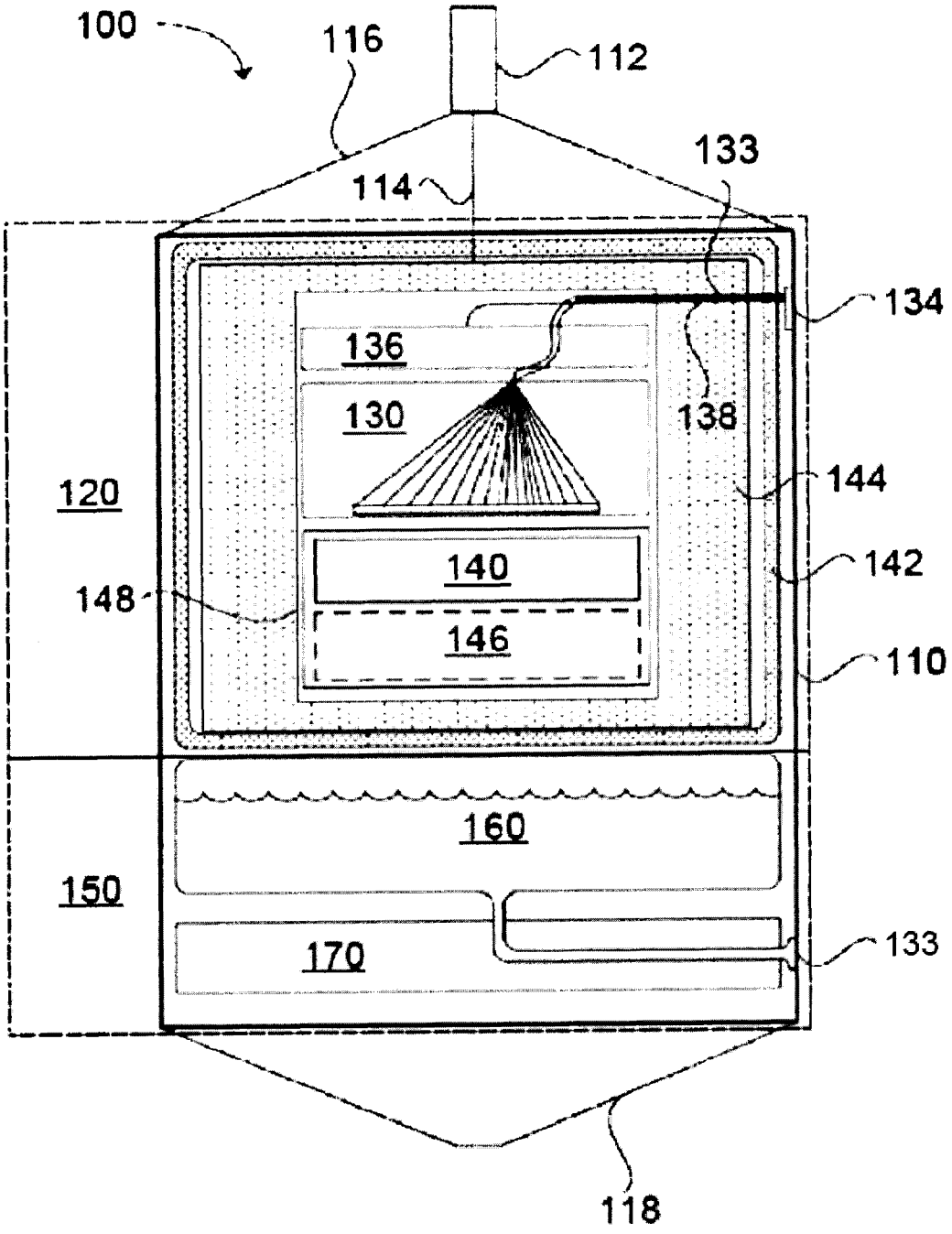
FIG. 1 is a side cross-sectional view of an exemplary downhole deployable tool including a tracer delivery system, according to one embodiment.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description is not intended to limit the scope of the invention, as claimed, but is presented for purposes of illustration only to describe the features and characteristics of the present embodiments, to set forth the best mode of operation of the invention, and to sufficiently enable one skilled in the art to practice the invention. Accordingly, the scope of the present invention is to be defined solely by the appended claims.

In describing and claiming the present invention, the following terminology will be used.

The singular forms "a," "an," and "the" include plural referents unless the context clearly dictates otherwise. Thus, for example, reference to "a particle" includes reference to one or more of such materials and reference to "subjecting" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

The downhole deployable tool can include a tracer injection system and a tracer detection system that can be contained within an elongated tubular casing. The tubular casing can allow the tool to be suspended by a wireline and introduced into a wellbore. The tool can have any diameter that is less than the wellbore diameter, but for practical purposes the tool can have a diameter less than a lubricator that allows for the passage of the wireline cable into the high pressure environment behind the wellhead.

As illustrated in FIG. 1, a downhole deployable tool 100 for measuring tracer concentrations can include a housing 110 and a detector system 120 within the housing 110. The housing 110 can be attached to a wireline support cable 112 that allows the tool to be lowered into a wellbore and raised from the wellbore. The housing 110 can include an energy collector 134 such as a detector window on the exterior of the housing 110 or an optical fiber bundle 133 that provides an interface on the exterior of the housing 110. The energy collector 134 can collect energy from surrounding fluid, and deliver excitation energy to target materials in surrounding fluid. The detector system 120 can be oriented within the housing 110 such that the detector 130 can be operably connected to the energy collector 134 to direct emitted light or energy to the detector 130.

Although the tool 100 can be used in low temperature environments, one area of application can be for high temperature applications such as geothermal wellbore analysis. The housing 110 can be used to protect the detector 130 and other components from exposure to the surrounding environment, including corrosion and temperature. The temperatures of fluids, primarily water, within a geothermal wellbore can typically range from 150° C. to 300° C., which temperatures can be harmful and destructive to ordinary electronics. Electronics usually can operate well in a temperature range from 0° C. to 70° C. Electronic components can start to melt on Silicon (Si) dies used in many electronics at temperature exceeding 150° C.

Optionally, the detector system 120 can be partially or completely encased by an insulation material. Therefore, the detector system 120 can be completely or at least partially encased in an insulator 142 using an insulating material, so the components can provide proper functionality for a specified time within an extreme temperature environment, such as a geothermal wellbore. Insulating materials can include materials with a relatively low thermal conductivity (K), such as nitrogen ($N_2$), air, silica aerogel, vacuum, composites, or combination of materials. Thermal conductivity (K) is a property of a material describing material's ability to conduct heat. Silica aerogel can have a thermal conductivity (K) from 0.03 Watt/meter·Kelvin [W/(m·K)] down to 0.004 W/(m·K) for temperature range between 25° C. and 127° C. N2 or air may have a thermal conductivity (K) approximately 0.025 W/(m·K) for temperature range between 25° C. and 127° C. A vacuum can have a thermal conductivity (K) less than air or nitrogen, which can vary based on the quality of the vacuum. The detector system 120 can be completely or at least partially encased in a vacuum insulation vessel, such as a Dewar insulation vessel. The vacuum insulation vessel can provide limited interfaces across the vacuum or and insulating materials used in the insulation for electrical, optical, and support cabling while maintaining insulating properties. Materials used in the insulator and other tool components can have a relatively high melting temperature to reduce wear and provide proper functionality.

An optional heat sink 144 can be used to dissipate heat, evenly distribute the temperature within the housing 110, pull heat away from the electronics, absorb energy in a heat sink mass, and/or absorb heat in a dedicated location remote from other components. In one aspect, the detector system 120 can be at least partially encased in a heat sink 144, such as material with a high thermal conductivity (K) and/or a high heat capacity (C). A heat sink can be used to dissipate heat, evenly distribute the temperature within the housing. The heat sink 144 can protect the electronics 148, including the detector electronics 130, in high temperature applications. The heat sink material can be a metal, such as copper (Cu), silver (Ag), platinum (Pt), aluminum (Al), gold (Au), and other materials with a high thermal conductivity (K) and a high heat capacity (C). The heat sink material can have a thermal conductivity (K) greater than 175 W/(m·K) for a temperature range between 25° C. and 127° C. Copper (Cu), silver (Ag), pure aluminum (Al), and alloy aluminum have thermal conductivities (K) of 401, 429, 237, and 120-180 W/(m·K), respectively. As a general rule, materials having a thermal conductivity (at 25° C.) from about 3 to about 5 W/(cm·° C.) can be suitable. Heat capacity (usually denoted by a capital C) can be the measurable physical quantity that characterizes the amount of heat required to change a mass's temperature by a given amount. Although other materials can be suitable, typically a heat capacity from about 0.05 to about 0.22 cal/(g·° C.) can provide effective results. The heat sink 144 can be a structure and a combination of materials to both pull heat away from the electronics and absorb heat leaking into the device or absorbed by the tool 100 from the external environment.

In another optional aspect, the tool 100 can have a fluid coolant system (not shown) to reduce temperatures of the detector system 120, including the electronics 148. The coolant can be transferred in and out of the tool 100 from a surface reservoir or used to transfer heat within the tool 100 away from heat sensitive electronics or other heat sensitive materials. The coolant can be pumped and transferred to and from the surface using tubing running with the support cable 112. Alternatively, or in addition, the electronics and other components can be formed of high temperature materials, such as gallium arsenide (GaAs), so that the tool 100 can operate longer in high temperature conditions or so that less heat sink material or insulation materials may be used in the tool 100 and still provide the same functionality.

The support cable 112 can be attached to the housing 110 to allow the tool 100 to be suspended by the support cable. The support cable 112 can serve as a mechanical support line, a power supply line, and/or a data transmission cable. In one aspect, the support cable 112 includes a wireline 114 configured to communicate data from the detector system 120 to a receiving station (not shown) and/or provide electrical power. Typically, the receiving station, if present, can be retained at the surface. The receiving station can be actively monitored and/or include a data logging system to allow collection of data which can be retrieved and analyzed later. The receiving station can be a computer processor, such as a PC, handheld device, or other suitable computation device which includes data memory and processing capabilities. In another aspect, the support cable 112 can be free of data communication and the detector system 120 can include a data storage module 146.

The support cable 112 can be any suitable cable, and in high temperature applications the cable can withstand heat. Some non-limiting examples of support cable can include electrical downhole cables (multilayered cables such as those available from Weatherford International, Schlumberger, GCDT, and others), optical fiber cables (multimode or single mode such as those available from AFL Telecommunications and others), twisted cable, and the like.

At one end 116 of the tool 100 can be the detector 130, which can be any detector that is appropriate for measuring tracer concentrations. The detector 130 in the detection system 120 can be configured to measure at least one of radioactivity, electron capture, fluorescence, absorption, photoionization and conductivity. In each case, the detector 130 and corresponding electronic components can be configured to translate the corresponding energy effect on the detector 130 into useful information. Examples of tracers that can be detected include perhalogenated compounds (e.g. perfluoromethylcyclopentane), light-absorbing dyes (e.g. methylene blue), fluorescent dyes (e.g. fluorescein, rhodamine WT, eosin Y, etc.), electrically charged compounds (e.g. lithium, sodium, chloride, bromide), and short-chain aliphatic compounds (e.g. ethanol and propanol).

In one embodiment, the tracer is a fluorescent compound and the detector 130 can be a photomultiplier fluorescence detector. Within the detector system 120, light from a light source 136 can be configured to send light through an optical fiber 138 and the energy collector 134 at a given wavelength and allowed to illuminate the tracer outside of the tool 100 within the wellbore. The incident light can be captured by the tracer, which then re-emits the light at a second (usually longer) wavelength. The emitted light can then be captured by optical fiber bundle 133 and returned to a photodiode detector 130 in order to calculate the tracer concentration within the wellbore.

The detector 130 can be configured to operate in high temperature fluid and gas environments for specified time, such as about 2 hours although other times can be achieved through choice of insulation mechanisms and materials. Although operating temperatures can vary, often the high temperature fluid and gas can have a temperature between 150° C. and 300° C. However, in some cases the high temperature fluid and gas can have a temperature that exceeds 300° C. Advantageously, the detector 130 can be configured to measure both laminar and turbulent flows. The detector 130 can optionally be configured to measure a liquid-phase tracer and a gas phase tracer. The detector 130 can be configured to measure at least one of fluorescence, electron capture, absorption, and conductivity. In each case, the detector 130 and corresponding electronic components can be configured to translate the corresponding energy effect on the detector 130 into useful information.

In one aspect, the detector system 120 further includes a light source configured to send light from the tool sufficient to trigger a response from target materials outside of the tool 100 such that the response can be registered by the energy collector 134. In one aspect, the light source 136 can be a LED or laser light source. The energy collector 134 can include a detector window or an optical fiber bundle 133. The detector window can include quartz or other translucent material to pass light and energy. For example, one configuration provides a detector window having a diameter or dimension of approximately 100 mm to allow detection of 900-1000 nm wavelength electromagnetic energy (or light) by the tool 100. The detector 130 can be operably connected to the energy collector 134 using a fiber bundle 133. Alternatively, the detector 130 can be oriented directly adjacent the detector window to render such fiber optics optional (not shown). The detector 130 can be a photodetector such as a photodiode or a photomultiplier. A detector 130 can be a spectrometer or a silicon-based charge-coupled device (CCD). The detector 130 can be configured to register light energy having a certain wavelength or energy value which can be correlated to specific ranges. In one implementation, the end of the optical fiber can be attached to a detector at the surface.

The detector system 120 can further include splitters or filters to spatially distribute incoming energy according to wavelength. This can be useful in discriminating a spectrum of energy wavelengths, such as multiple energy sources or tracers. Depending on the particular detector, a signal can be produced which can be correlated with a numerical value or other information. In one aspect, the detector system 120 further includes a microcontroller 140, state machine, processor, memory, input/output circuitry, and other electronics and computer components supporting processing which can be operably connected to the detector 130 to process signals from the detector 130. In one aspect, the microcontroller 140 can be an 8051-based architecture microcontroller. Other suitable microcontroller 140 or processing units can also be used.

The tool 100 can be used for detection of particular tracer compositions. The tracer compositions can be introduced into the wellbore and/or geological reservoir via a tracer delivery system 150 within the tool, a dedicated tracer injection line (not shown) with tracer compositions that can be pumped from the surface, or a separate tool 300 (FIG. 3) that can be lowered into the wellbore to deliver the tracer composition.

As illustrated in FIG. 1, the tool 100 can include a tracer delivery system 150 such that a single tool can be used to deliver and measure tracer within the wellbore. The tracer delivery system 150 can include a tracer reservoir 160 as well as a metering pump 170. The metering pump 170 can be a high pressure metering pump to accurately control release of the tracer composition into the wellbore. The tracer delivery system 150 can include a valve control which can be preprogrammed or activated based on instructions from the surface via the support cable 112 or from corresponding microcontroller 140 on-board the tool 100. The microcontroller 140 unit can be separate or integrated with the processing unit used for collection of data from the detector 130. In this way, the tracer delivery system 150 can be electrically connected to the detector system 120 to allow coordination of delivery of tracer and measurement of tracer concentration. This configuration can be desirable for using the tool 100 as a flow rate measurement tool. Furthermore, such tool 100 can be used to measure tracer concentration injected from a distant wellbore while the reservoir is not concurrently utilized.

The tracer reservoir 160 can be formed having a space between the reservoir and the outer casing or housing 110 to allow for differences in expansion as the tool 100 is heated from surrounding thermal sources. However, the casing materials can also have a sufficiently similar coefficient of thermal expansion to allow the layers to expand without a breach in fluid containment. The tracer delivery system 150, metering pump 170, and/or tracer reservoir 160 can use an insulator and/or heat sink 144. The tracer reservoir 160 can be configured to hold a small volume of tracer compositions. As a general rule, small amounts of tracer are those sufficient to produce a measurable concentration within the same wellbore for purposes of flow rate measurements. Although any functional volume can be used, volumes from about 5 ml to about 100 ml, such as about 10 ml, are often suitable. The tracer reservoir 160 can include a tracer fluid suitable for the particular application. Non-limiting examples of suitable tracer fluids include perhalogenated compounds, light absorbing dyes, fluorescent dyes, short-chain aliphatic alcohols, electrically charged compounds, and combinations of these tracers. The tracer composition can generally be a fluorescent tracer, a perhalogenated tracer, a light absorbing tracer, or an electrically charged tracer.

The tracer can be pumped into the wellbore through a port 132 at another end 118 of the tool 100. By measuring the pump flow rate and the concentration of the tracer after the tracer has mixed completely with the fluid in the wellbore, the flow rate may be calculated within the wellbore. One approach for calculating flow rate is described in Hirtz, P. N., Kunzman R. J., Broaddus, M. L., and Barbitta, J. A., 2001, "Developments in Tracer Flow Testing for Geothermal Production Engineering", Geothermics, Vol. 30(6), pp. 727-745 and in Lovelock, B. G., (2001) "Steam Flow Measurements Using Alcohol Tracers", Geothermics, Vol. 30(6), pp. 641-654, both of which articles are incorporated herein by reference. Using this approach, the tool may be used a flow meter.

Mass flow rate (m·) is calculated from the concentration of the tracer (X) and the rate at which the tracer is delivered (Q) from port 132:

$$\dot{m}\left(\frac{m_{water}}{t}\right) = \frac{Q\left(\frac{m_{tracer}}{t}\right)}{X\left(\frac{m_{tracer}}{m_{water}}\right)} \tag{1}$$

A volumetric flow rate can then be calculated based upon fluid density and mass flow rate.

As illustrated in FIG. 1 and as previously presented, the tool 100 can include the tracer injection system 150 and the tracer detection system 120 in a single tool 100, which can include electronic circuitry 148 and software for controlling the pump 170 and detector 130, a Dewar vessel 142 for insulating the tool from the high temperatures within the wellbore, and a heat sink 144 that serves to delay internal-temperature increases. The tool 100 can include a gamma detector and pressure and temperature sensors. The temperature sensors can in include an external temperature sensor or a wellbore temperature sensor, and an internal temperature sensor or a circuitry temperature sensor. The wellbore sensor can be a probe coupled to the housing 110 and the circuitry sensor can be coupled to a circuitry component (or within a electronic chip or die) likely to fail due to extreme temperatures. The external and internal temperature sensors may be monitored and/or recorded to determine a maximum or optimal time that the tool 100 may remain in a wellbore before the microprocessor 140, detector 130, emitter, and other circuits may fail or cause excessive wear due to temperature. If the data storage module 146 is used, temperature sampling may be recorded by the internal data storage module 146 and processed by the microprocessor 140 to create a temperature profile. If a data transmission cable is used to communicate with the surface, the temperature of the tool 100 and circuitry can be monitored in real-time, so the tool 100 can be extracted before heat causes any substantial damage to the detector 130, emitter, circuitry, pump 170, or other components of the tool 100. Keeping the circuits below a safe operating temperature can extend the life of the tool 100.

In another example, the tracer injection system 150 can be on a top end of the tool 100 supported by the support cable 112 and the tracer detection system 150 can be on the bottom end 118 of the tool 100 (not shown).

Figure 2:
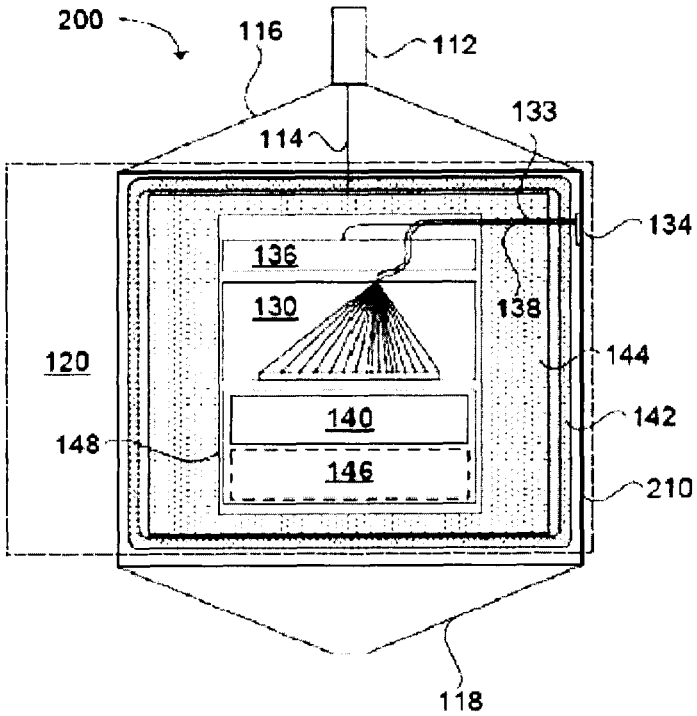
FIG. 2 is a side cross-sectional view of an exemplary downhole deployable tracer measuring tool, according to one embodiment.

In another aspect, as illustrated in FIG. 2, the tool 200 can include the tracer detection system 120, which can include electronic circuitry 148 and software for controlling the detector 130, an insulator 142 for insulating the tool 200 from the high temperatures within the wellbore, a heat sink 144 that serves to delay internal-temperature increases, and a housing 210 to protect the tool 200 from the environment, which can include salts and other corrosive compounds.

Figure 3:
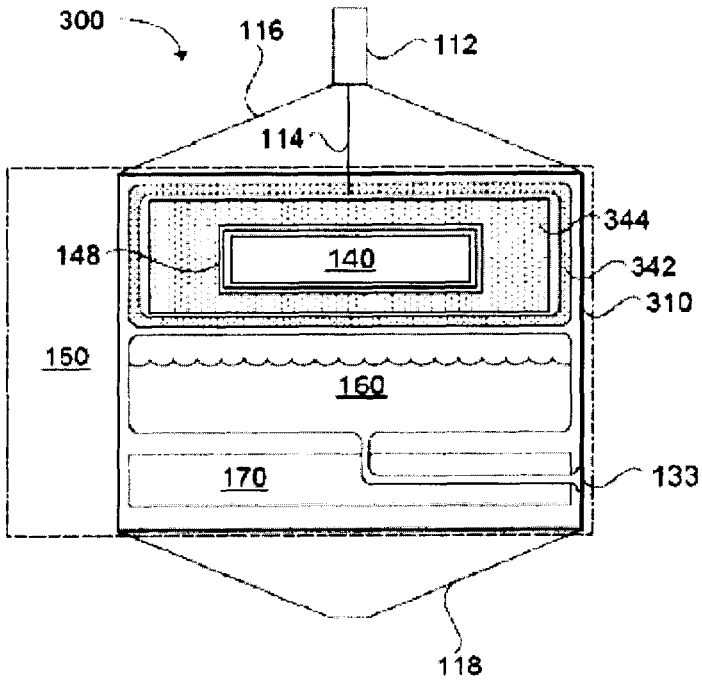
FIG. 3 is a side cross-sectional view of an exemplary downhole deployable tracer delivery tool, according to one embodiment.

In another aspect, as illustrated in FIG. 3, the tool 300 can include the tracer injection system 150, which can include electronic circuitry 148 and software for controlling and monitoring the pump 170, a tracer reservoir 160, an insulator 342 for insulating the tool 300 from the high temperatures within the wellbore, and a thermal sink 344 that serves to delay internal-temperature increases, and a housing 310 to protect the tool 300 from the environment. The tracer delivery tool 300 can include a data storage module (not shown) for recording tracer compositions delivery.

The tool of FIGS. 1-3 can include a clock along with a data storage module to record and synchronize the delivery and detection of the tracer, and/or a communication cable can connect devices to provide real-time recording and synchronization.

Figure 4:
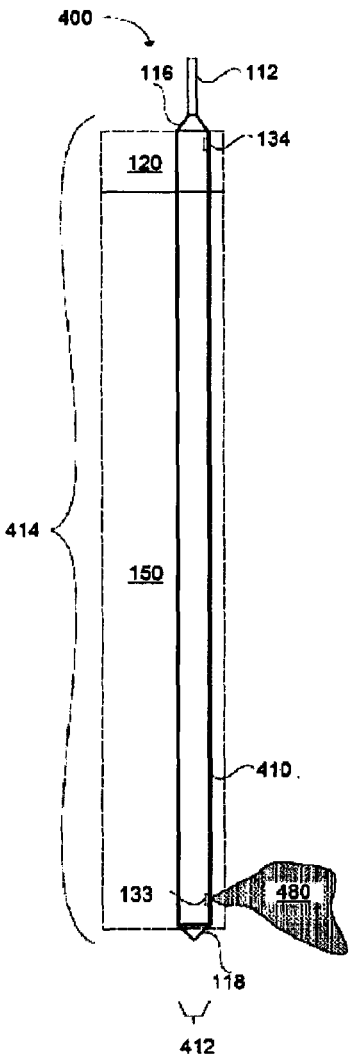
FIG. 4 is a side view of an exemplary downhole deployable tool including a tracer delivery system, according to one embodiment.

Any suitable shape or size can be used for the tool. However, as a general matter, the size can be sufficient to allow the tool to be lowered into a wellbore. Wellbore diameters can vary considerably but can generally range from about three inches to several feet in the event of a borehole washout. As illustrated in FIG. 4, the outer diameter 412 of the housing 410 of the tool 400 can be narrower than the length 414. Typically, the housing 410 can be elongated such that the aspect ratio is from about 10 to about 60, although other dimensions can be suitable. In one aspect, the housing 410 can have an outer diameter of about 2.75 inches and a length of 8 feet. The housing 410 can be formed of any suitable material and can be single or multi-layered. Especially for high temperature applications, certain high temperature materials can be desirable. Non-limiting examples of suitable housing materials can include stainless steel, refractory metal (W, Ta, Ti, Mo, etc), ceramics (e.g. SiC, Si3N4, aluminas, carbides, nitrides, amorphous carbon, silicates, etc), graphite, polymers (including high temperature polymers, silicones, urethanes, epoxies, polyimides, etc.) and composites thereof.

Figure 5:
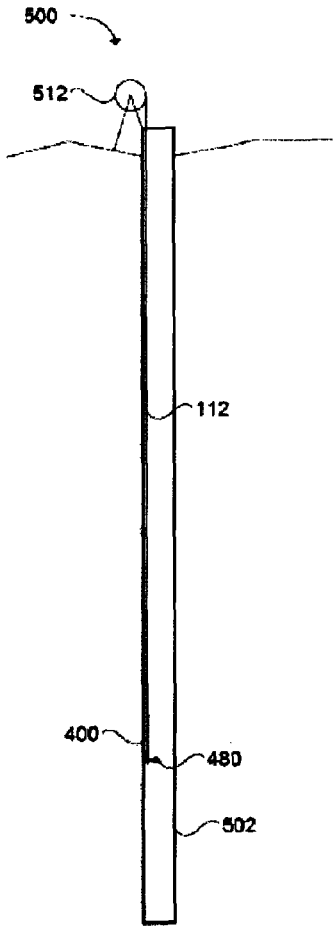
FIG. 5 is a side cross-sectional view of a wellbore with an exemplary downhole deployable tool including a tracer delivery system, according to one embodiment.

A method of using the downhole deployable tool 400 can include delivering a tracer composition 480 into a wellbore 502, as illustrated in FIG. 5. Lowering the tool 400 into the wellbore 502 can be done either during, before or after delivering the tracer composition 480 into the wellbore 502. The tool 400 can be lowered and raised by a hoist 512 with the support cable 112 at a consistent or known speed. The depth of the tool 400 can be determined by the speed of the hoist 512, the length of the cable 112, or a pressure sensor within the tool 400. A concentration of the tracer composition 480 can be measured as a function of position along the wellbore 502 and as a function of time.

The downhole deployable tools disclosed can have the advantage over a conventional spinner tool of being able to measure volumetric flow rate, as opposed to linear flow rate-thus avoiding the problem of a non-uniform borehole diameter. The downhole deployable tools can have no moving parts (non-mechanical) downhole and thus can be much less susceptible to failure, especially at high temperatures and high flow rates. The tools disclosed can provide a method of quantifying either single-phase or two-phase flow within geothermal wellbores with improved reliability and accuracy.

Figure 6:
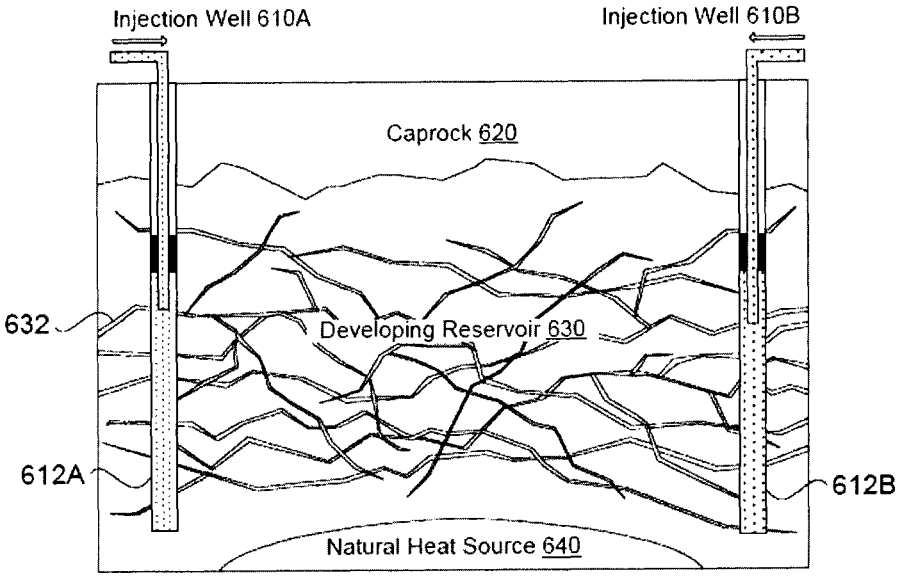
FIG. 6 is a side cross-sectional view of an exemplary developing reservoir, according to one embodiment.
Figure 7:
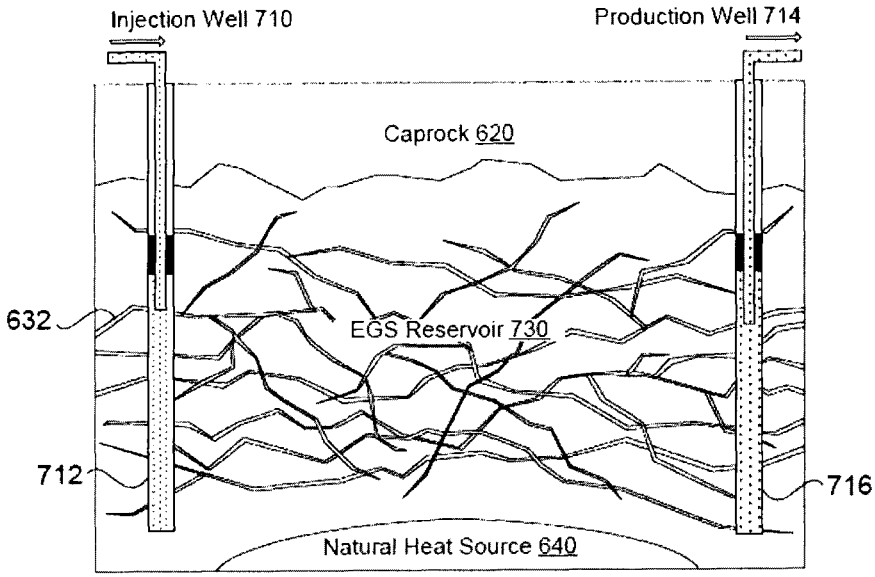
FIG. 7 is a side cross-sectional view of an exemplary Engineered Geothermal System (EGS) reservoir, according to one embodiment.

The downhole deployable tools described can be used to identify fractures and to measure flow rates within a petroleum, groundwater, or geothermal well. With the tools disclosed, tracers can be injected into a wellbore 612A, 612B, 712, or 716 and allowed to enter fractures 632 that intersect the wellbore, as illustrated in FIGS. 6-7. The tool can be subsequently moved up or down within the wellbore 612A, 612B, 712 or 716 and used to identify tracers flowing back from fractures 632 into the wellbore 612A, 612B, 712 or 716, thereby identifying the locations of permeable fractures. The detectors can measure the bleed back of the tracers when the pressure used create fractures 632 is released. Alternatively, tracers can be introduced gradually into a well as the tool is made to move up or down within the wellbore 612A, 612B, 712 or 716. Tracer concentration can be measured and used to calculate quantitatively the flow rate of fluid either entering or leaving the well via fractures that intersect the wellbore 612A, 612B, 712 or 716.

The tool can be applied in at least two distinct modes. In a first mode, the tool can be used to identify newly created fractures as part of a procedure to develop an Engineered Geothermal System (EGS). However, the tool can be suitable for use in oil and gas wells or other wellbores where fracture characterization information is desirable. In a second mode, the tool can be used to measure the downhole flow rate of fluids entering or exiting a wellbore for either groundwater, petroleum, or geothermal applications. The tool may be used in other modes as well.

As illustrated in FIG. 6, a developing geothermal reservoir 630 may have existing fractures 632 below the surface and a caprock 620. A natural heat source 640 within the ground may heat water and other fluids in the ground. Wellbores 612A, 612B may be drilled into a developing reservoir 630. Wellbores 612A and 612B used to pump or inject fluids into the ground can be referred to as injection wells 610A and 610B. Wellbores use to pump fluids out of the ground can be referred to as production wells. Engineered Geothermal Systems (EGS) systems can be developed from a developing reservoir 630.

The tool can allow for the identification of newly created fractures along the length of a geothermal or EGS wellbore. An EGS can be a geological formation that is both hot and tectonically stressed, but lacking in permeability. In order to enhance permeability in an EGS, a fluid (typically water) can be pumped into the formation at high pressure via a wellbore. By increasing the pore pressure, fractures fail in shear and permeability can be enhanced. By tagging the stimulation fluid with a suitable tracer, fluids in fractures that are opened in shear through the stimulation process can likewise tagged. Alternatively, if multiple zones are stimulated in multiple stimulation episodes, each wellbore can be tagged with a distinct tracer, so quantifying the success of the stimulation process can be possible and determining when the well has been sufficiently stimulated.

As illustrated in FIG. 7, the procedure can involve the deployment of the tool up or down the wellbore 712 and 716 (e.g. either injection wells 710 or production wells 714) after the stimulation is complete and after the individual fracture sets have each been tagged with a distinctive fluorescent tracer. Injection wells and productions wells can be used within an EGS reservoir 730. As the tool is raised or lowered past each newly created (and tagged) fracture set, the tool can detect and identify each tracer. By comparing the depth of the fracture set with the identity of each tracer, determining which fracture set was activated during each stimulation episode can be achieved.

A modification of a tracer-dilution (tracer flow testing) method used to measure two-phase flow at geothermal wellheads and elsewhere can be performed. A liquid-phase geothermal tracer and a gas-phase geothermal tracer can be introduced into a wellbore from a reservoir within the tool at a known concentration and at a fixed rate. By measuring the concentration of the diluted tracer at the other end of the tool, the volumetric flow rate (either single phase liquid or two phase liquid and gas) of fluid flowing up a wellbore can be determined. A fluorimeter can measure the liquid phase tracer and the gas-phase tracer can be measured using the tool. By raising the tool assembly along the well bore, the flow (either liquid or gas) can be quantified as a function of depth within the wellbore.

Accurate measurement of the rate of fluid passing from fractures into a wellbore facilitates the diagnosis of well performance both for EGS and for conventional geothermal systems. Typically such measurement can be challenging both within very low (laminar) and very high (turbulent) flow regimes. The tool can be designed to quantify flow rate through tracer dilution of both laminar and turbulent flows. Quantifying flow rate through tracer dilution can involve the introduction of a tracer solution at a known concentration and rate in conjunction with the measurement of the solution concentration after it has mixed thoroughly with the fluid flowing within the wellbore. Measurement of turbulent flows can be effective when the tracer dispensing point and the detector are separated by at least six feet for typical flow rates in geothermal wells. Smaller distances tend to leave insufficient mixing to obtain consistent measurements. Laminar flow regimes present similar mixing difficulties. As such, optional mixing features can be added to the tool in order to facilitate mixing of the tracer with surrounding fluid. For example, recirculation jets can be provided where fluid intake at a bottom end of the tool is redirected vertically and/or back opposite bulk flow so as to induce mixing and disruptive flow adjacent the tool. Optional baffles, brushes, or mixing members can be oriented along the outer side housing of the tool to induce mixing of the tracer with fluids sufficient to obtain substantially even mixing across the wellbore.

A fluorescence-detection approach can allow for the introduction of a nontoxic and environmentally benign fluorescent tracer into a geothermal or EGS well near the end of a stimulation experiment. By subsequently passing the downhole fluorimeter along the wellbore, each fracture would exhibit a fluorescent trace that could be used to quantify the success of the stimulation experiment and the use of expensive and hazardous radioactive tracing techniques could be avoided.

Additional components can be added to the tool. For example, an optional internal temperature sensor can be oriented within the tool adjacent electronics. This can allow monitoring of internal temperatures and removal of the tool once maximum safe operating temperatures are reached within the tool. Motion and inclination of the tool can be monitored using an optional accelerometer oriented within the tool housing.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. An apparatus, comprising:

a support cable configured to allow the apparatus to be lowered into and raised from a wellbore;

a housing attached to the support cable, where the housing includes a detector window on the exterior of the housing;

a tracer delivery system that delivers a tracer composition having a first tracer concentration at a given pump rate into the wellbore; and a detector system within the housing that includes a detector that measures a second tracer concentration, wherein the second tracer concentration is a concentration after the tracer composition has substantially completely mixed with a well fluid in the wellbore, wherein the detector is operably connected to the detector window to direct energy from the detector window to the detector, and wherein the detector system includes a processing unit that determines a flow rate of the well fluid in the wellbore based on the first tracer concentration, the second tracer concentration, and the given pump rate.

2. The apparatus of claim 1, wherein the detector system is at least partially encased in a vacuum insulation vessel.

3. The apparatus of claim 1, further comprising a fluid coolant system to reduce temperatures of the detector system.

4. The apparatus of claim 1, wherein the detector system is at least partially encased in a heat sink.

5. The apparatus of claim 1, wherein the detector system is configured to operate in high temperature fluid and gas environment for at least 2 hours, wherein high temperature fluids and gases exceed a temperature of 300° C.

6. The apparatus of claim 1, wherein the detector is configured to measure at least one of fluorescence, radioactivity, electron capture, absorption, photo-ionization, and conductivity.

7. The apparatus of claim 1, wherein the detector is configured to measure laminar and turbulent flows.

8. The apparatus of claim 1, wherein the detector system further includes a light source configured to emit light through the detector window sufficient to trigger a response from target materials outside of the apparatus.

9. The apparatus of claim 8, wherein the light source is at least one of a light-emitting diode (LED) and a laser light source.

10. The apparatus of claim 1, wherein the detector is configured to measure at least one of a liquid-phase tracer and gas-phase tracer.

11. The apparatus of claim 1, wherein the support cable includes a communication cable configured to communicate data from the detector system to a receiving station.

12. The apparatus of claim 1, wherein the detector system includes a data storage module and the support cable is free of data communication.

13. The apparatus of claim 1, wherein the detector is operably connected to the detector window using a fiber optic cable.

14. The apparatus of claim 1, wherein the detector is at least one of a photomultiplier and a photodiode.

15. The apparatus of claim 1, wherein the detector system further includes a splitter to spatially distribute incoming energy according to wavelength.

16. The apparatus of claim 1, wherein the detector system further includes a microcontroller operably connected to the detector to process signals from the detector.

17. The apparatus of claim 1, further comprising a tracer delivery system which includes a tracer reservoir.

18. The apparatus of claim 17, wherein the tracer delivery system further includes a high pressure pump.

19. The apparatus of claim 17, wherein the tracer reservoir includes a tracer fluid selected from the group consisting of perhalogenated compounds, light absorbing dyes, fluorescent dyes, electrically charged compounds, short-chain aliphatic alcohols and combinations thereof.

20. The apparatus of claim 17, wherein the tracer delivery system is electrically connected to the detector system to allow coordination of delivery of tracer and measurement of tracer concentration.

21. The apparatus of claim 1, wherein the flow rate is determined using the formula $$\dot{m} = \frac{Q}{X}$$

where $\dot{m}$ is the flow rate of the well fluid, Q is a rate at which the tracer is delivered, and X is the second tracer concentration.

22. A method, comprising:

delivering a tracer composition having a first tracer concentration at a given pump rate into a wellbore from one end of a tool;

lowering the tool into the wellbore;

determining a second tracer concentration of the delivered tracer composition in the wellbore, wherein the second tracer concentration is a concentration after the tracer composition has substantially completely mixed with a well fluid in the wellbore; and determining a flow rate of the well fluid in the wellbore based on the first tracer concentration, the second tracer concentration and the given pump rate.

23. The method of claim 22, wherein the tracer composition is a fluorescent tracer, a perhalogenated tracer, a short-chain aliphatic alcohol or an electrically charged tracer.

24. The method of claim 22, wherein the wellbore is a geothermal wellbore.

25. The method of claim 22, wherein the flow rate is determined using the formula $$\dot{m} = \frac{Q}{X}$$

where $\dot{m}$ is the flow rate of the well fluid, Q is a rate at which the tracer is delivered, and X is the second tracer concentration.

* * * * *